US006152689A

United States Patent [19]

Yokota et al.

[11] Patent Number: 6,152,689

[45] Date of Patent: Nov. 28, 2000

[54] SELF-PRIMING TYPE CETRIFUGAL PUMP

[75] Inventors: Hiroshi Yokota, 11-11-302, Midori 1-chome; Shingo Yokota, 17-27, Midori 3-chome, both of Minami-ku, Hiroshima-shi, Hiroshima-ken, Japan

[73] Assignees: Kabushiki Kaisha Yokota Seisakusho; Hiroshi Yokota; Shingo Yokota, all of Hiroshima-Ken, Japan

[21] Appl. No.: 09/230,251

[22] PCT Filed: Mar. 17, 1997

[86] PCT No.: PCT/JP97/00857

§ 371 Date: Jan. 22, 1999

§ 102(e) Date: Jan. 22, 1999

[87] PCT Pub. No.: WO98/04833

PCT Pub. Date: Feb. 5, 1998

[30] Foreign Application Priority Data

Jul. 26, 1996 [JP] Japan ..... 8-197542

[51] Int. Cl.[7] ..... F04D 17/08

[52] U.S. Cl. ..... 415/56.1; 415/55.6; 415/58.1; 415/143; 415/169.1; 417/199.2

[58] Field of Search ..... 415/56.1, 56.2, 415/56.3, 56.4, 56.5, 56.6, 58.1, 58.4, 169.1, 143; 417/199.2, 201, 202

[56] References Cited

U.S. PATENT DOCUMENTS

| | | | |
|---|---|---|---|
| 3,230,890 | 1/1966 | Yokota . | |
| 5,536,147 | 7/1996 | Lang | 417/199.2 |
| 5,772,394 | 6/1998 | Yokota et al. . | |

FOREIGN PATENT DOCUMENTS

| | | | |
|---|---|---|---|
| 1254971 | 11/1967 | Germany | 417/199.2 |
| 40-3655 | 2/1965 | Japan . | |
| 42-3145 | 2/1967 | Japan . | |
| 57-97198 | 6/1982 | Japan . | |

*Primary Examiner*—Edward K. Look
*Assistant Examiner*—Liam McDowell
*Attorney, Agent, or Firm*—Ladas & Parry

[57] ABSTRACT

The invention provides a self-priming centrifugal pump capable of sucking up and pumping a highly viscous liquid containing muddy substances including a large amount of bubbles, and solid foreign matters, of preventing the flow of the liquid from the side of a main pump unit into a vacuum device and from the vacuum device into the main pump unit at all stages of operation including starting, operating and stopping stages and of perfectly automatic operation, and very economical in costs of equipment and maintenance.

The self-priming centrifugal pump has a main pump unit for pumping a liquid, an auxiliary pump unit for centrifugal gas-liquid separation, and an exhaust vacuum device. A region in the vicinity of a central part of an impeller included in the main pump unit is connected via a passage having a small passage area as compared with the discharge ability of the auxiliary pump unit to the suction opening of the auxiliary pump unit, the discharge opening of the auxiliary pump unit is connected to the suction opening of the main pump unit by a return passage, and a region in the vicinity of a central part of the impeller of the auxiliary pump unit is connected via an exhaust passage to the vacuum device. The exhaust passage includes in series therein a slow-acting valve which opens with a delay after the connection of a prime mover for driving the self-priming centrifugal pump to a power source, and a quick-acting valve which closes immediately after the disconnection of the prime mover from the power source.

14 Claims, 13 Drawing Sheets

SELF-PRIMING TYPE CETRIFUGAL PUMP

TECHNICAL FIELD

The present invention relates to a self-priming type centrifugal pump capable of pumping up even a highly-viscous liquid containing a large amount of bubbles, and muddy substances or solid foreign matters. More particularly, the present invention is intended to provide a high-performance, economical, self-priming centrifugal pump capable of perfectly automatic operation and not requiring troublesome work for maintenance.

BACKGROUND ART

Generally, a muddy substance having a high viscosity and containing a large amount of bubbles is difficult to pump by a centrifugal pump. Simple, safe means for pumping and transporting such a muddy substance further containing solid foreign matters has generally been desired. A conventional centrifugal pump cannot be simply used for the foregoing purpose even if the centrifugal pump is used in combination with a vacuum device because cavities formed in a region near the central part of the impeller by centrifugal separation cannot be easily replaced with a liquid having the foregoing properties.

Such a problem was solved clearly by an invention disclosed in JP-B-40-3655 relating to a centrifugal pump. As is apparent from JP-B-40-3655, this prior art centrifugal pump comprises, in combination, a main pump unit for pumping a liquid, and an auxiliary pump unit for removing cavities, having a suction opening which opens in the vicinity of a central part of the main impeller of the main pump unit and is disposed in parallel to the main pump unit, in which the suction opening of the auxiliary pump unit is formed in a small sectional area relative to the discharge ability of the auxiliary pump unit. The discharge opening of the auxiliary pump unit is opened into the suction side of the main pump unit. An exhaust passage is formed between a position near a central part of the auxiliary impeller of the auxiliary pump unit to a vacuum pump to remove forcibly cavities formed in the vicinity of the central part of the main impeller of the main pump unit so that the liquid can always be continuously pumped. A self-priming centrifugal pump disclosed in JP-B-42-3145 is an improvement of the invention disclosed in JP-B-40-3655. As shown in FIGS. 15 and 16, this prior art self-priming centrifugal pump is provided in its exhaust passage with a safety valve 6 to be operated by an actuator which is displaced by a negative pressure to prevent a vacuum (exhaust) pump 12 from failure in operation due to the flow of a liquid into the exhaust passage while the self-priming centrifugal pump is stopped. (Hereinafter, those invention will be referred to as "original inventions".)

This prior art device of the original inventions is capable of pumping up muddy substances which have been difficult to pump and has prevalently been used. However, the prior art device still has the following unsolved problems.

First, the prior art self-priming centrifugal pump relies on negative pressure produced by the vacuum pump to provide power to open the safety valve. Therefore, the negative pressure decreases when the safety valve is opened and the safety valve starts closing, and the negative pressure increases when the safety valve is closed and the safety valve starts opening. Thus, the safety valve repeats closing and opening operations to generate vibration and noise. It is possible that such a flapping action of the safety valve makes the operation of the safety valve unstable.

Secondly, any problem cannot arise because the discharge ability of the gas-liquid separating auxiliary pump unit surpassing the negative pressure produced by the vacuum pump isolates an exhaust system from the liquid while the self-priming centrifugal pump is in operation, and the safety valve is closed to isolate the exhaust system from the liquid while the pump is stopped. However, the discharge ability of the auxiliary pump unit becomes insufficient and the negative pressure produced by the vacuum pump overcomes the discharge ability of the auxiliary pump unit at a transient moment when the auxiliary pump unit operates at an operating speed lower than its normal operating speed, such as the moment the pump is started or the moment the pump starts stopping. Therefore, it is possible that the main pump unit communicates with the exhaust system, the liquid is sucked from the main pump unit into the vacuum pump by suction to contaminate the vacuum pump or to cause a failure in operation of the vacuum pump because the safety valve is half open at the transient moment. At the moment the pump starts stopping, it is possible that the liquid flows reverse into the vacuum pump for a moment if a high back pressure is acting on the discharge side of the main pump unit, or the working fluid of the vacuum pump (if the vacuum pump is of a liquid-seal type) is sucked into the main pump unit by a negative pressure produced by the reverse flow of the liquid if the suction lift of the main pump unit is high to cause working fluid loss and to contaminate the liquid.

Practically, problems arising from the instantaneous communication of the liquid with the exhaust system may be ignored when the self-priming centrifugal pump is used for pumping a common liquid, such as water, and the working fluid of the vacuum pump is water. However, if the self-priming centrifugal pump is used for pumping a liquid which must carefully be handled, such as a chemical liquid or a liquid foodstuff, both the contamination of the vacuum pump by the liquid and the contamination of the liquid by the working fluid of the vacuum pump are significant problems.

To solve such problems, the exhaust ability of the vacuum pump is reduced intentionally while the auxiliary pump unit is operating at an operating speed lower than its normal operating speed, or the self-priming centrifugal pump is provided with valves and cocks in addition to the safety valve and the additional valves and cocks are manually operated. However, these measures need complicated devices and troublesome work and the operation of the self-priming centrifugal pump falls far short of automatic operation. Thus, those measures could not have been substantial measures capable of solving those problems.

Accordingly, it is an object of the present invention to provide a durable self-priming centrifugal pump comprising a main pump unit and a vacuum device, having a simple construction, capable of drastically solving the foregoing problems in the prior art, employing new mechanisms and the like capable of stably and reliably functioning and maintaining the high performance of the self-priming centrifugal pump, capable of preventing the flow of liquids between the main pump unit and the vacuum device and of perfectly automatic operation, not requiring much work for maintenance, capable of being constructed in either a large size or a small size, and very economical in costs of equipment and maintenance.

DISCLOSURE OF THE INVENTION

With the foregoing object in view, the present invention provides a self-priming centrifugal pump comprising, a main pump unit for pumping a liquid, an auxiliary pump unit for centrifugal gas-liquid separation, and an exhaust vacuum device, in which a region in the vicinity of a central part of an impeller included in the main pump unit is connected via a passage having a small passage area as compared with a discharge ability of the auxiliary pump unit to the suction opening of the auxiliary pump unit, a delivery opening of the auxiliary pump unit is connected via a return passage to the suction opening of the main pump unit, a region in the vicinity of a central part of an impeller included in the auxiliary pump unit is connected via an exhaust passage to the vacuum device, and the exhaust passage includes in series therein a slow-acting valve which opens with a delay after the connection of a prime mover for driving the self-priming centrifugal pump to a power source, and a quick-acting valve which closes immediately after the disconnection of the prime mover from the power source.

According to the present invention, the slow-acting valve may be a valve which is controlled electrically for a timed opening operation.

The quick-acting valve may be a valve which is controlled electrically for a timed closing operation.

The vacuum device may be provided with a liquid-seal type vacuum pump, and the slow-acting valve may be a valve which opens when the pressure of the working fluid of the liquid-seal type vacuum pump increases.

The slow-acting valve and the quick-acting valve may be united in a single valve capable of slow opening and of quick closing.

The exhaust passage may be provided with valve means capable of connecting the exhaust passage to the atmosphere to reduce the vacuum force of the vacuum device when either the slow-acting valve or the quick-acting valve is closed to disconnect the exhaust passage from the region in the vicinity of the central part of the impeller of the auxiliary pump unit.

A float valve which opens when the liquid level in the exhaust passage of the auxiliary pump unit drops may be connected in series to the exhaust passage.

A liquid tank provided in its upper part with an inlet and an outlet may be connected in series to the exhaust passage.

Any or all of the main pump unit, the auxiliary pump unit and the vacuum device may have different rotating shaft systems.

All of the main pump unit, the auxiliary pump unit and the vacuum device may have one and the same rotating shaft system.

The respective impellers of the main pump unit and the auxiliary pump unit may be disposed contiguously and united together in a single unit.

The vacuum device may be provided with a liquid-seal type vacuum pump, a cooling device for cooling the working fluid of the liquid-seal type vacuum pump may be formed contiguously with a passage through which the liquid pumped by the main pump unit flows, and the cooling device may be provided with an inlet connected to the exhaust opening of the liquid-seal type vacuum pump and an outlet connected to the suction opening of the liquid-seal type vacuum pump.

A rotary cutting blade and a fixed cutting blade may be disposed near the suction opening of the main pump unit so as to correspond to each other.

The suction opening of the passage extending between the region in the vicinity of a central part of the impeller of the main pump unit and the suction opening of the auxiliary pump unit may face a region near the suction side of the impeller of the main pump unit in which cavities are formed.

The self-priming centrifugal pump (hereinafter referred to simply as the "pump") exercises the following effects.

When the pump is started, i.e., when the prime mover is connected to a power source, the slow-acting valve opens with a delay regardless of the opening speed of the quick-acting valve.

Therefore, the exhaust passage fully opens after the operating speed (discharge ability) of the auxiliary pump unit has increased to a level high enough for centrifugal gas-liquid separation and hence the liquid is not sucked from the main pump unit to the vacuum device.

While the pump is in operation, cavities formed near the central part of the main pump unit is drawn by the auxiliary pump unit for centrifugal gas-liquid separation, the liquid separated from gas is returned to the main pump unit, the gas separated from the liquid is exhausted through the exhaust passage in which both the slow-acting valve and the quick-acting valve are open by the vacuum device, and the main pump unit pumps the liquid continuously. While the liquid is thus continuously pumped, the auxiliary pump is maintained at the operating speed (discharge ability) sufficient for centrifugal gas-liquid separation. Therefore, the liquid will flow neither from the main pump unit into the vacuum device nor from the vacuum device into the main pump unit.

When the prime mover is disconnected from the power source to stop the operation of the pump, the quick-acting valve closes immediately regardless of the closing speed of the slow-acting valve. Therefore, the exhaust passage is closed forcibly even if a negative pressure (vacuum) prevails in the exhaust passage and, consequently, the liquid will flow neither from the main pump unit into the vacuum device nor from the vacuum device into the main pump unit.

While the pump is stopped, the liquid will flow neither from the main pump unit into the vacuum device nor from the vacuum device into the main pump unit because both the slow-acting valve and the quick-acting valve are closed.

The foregoing objects can be easily and economically achieved by those functions.

The flow of the liquid between the main pump unit and the vacuum device can be prevented for the perfect safety management of the apparatus even if the series of functional devices is damaged and unable to function properly by providing the exhaust passage with the float valve and the liquid tank. If necessary, the pump can be easily adapted for various uses by providing the pump with a cooling system for suppressing the rise of the temperature of the vacuum device or a crushing mechanism for crushing foreign matters contained in the liquid.

BEST MODE FOR CARRYING OUT THE INVENTION

Figure 1:
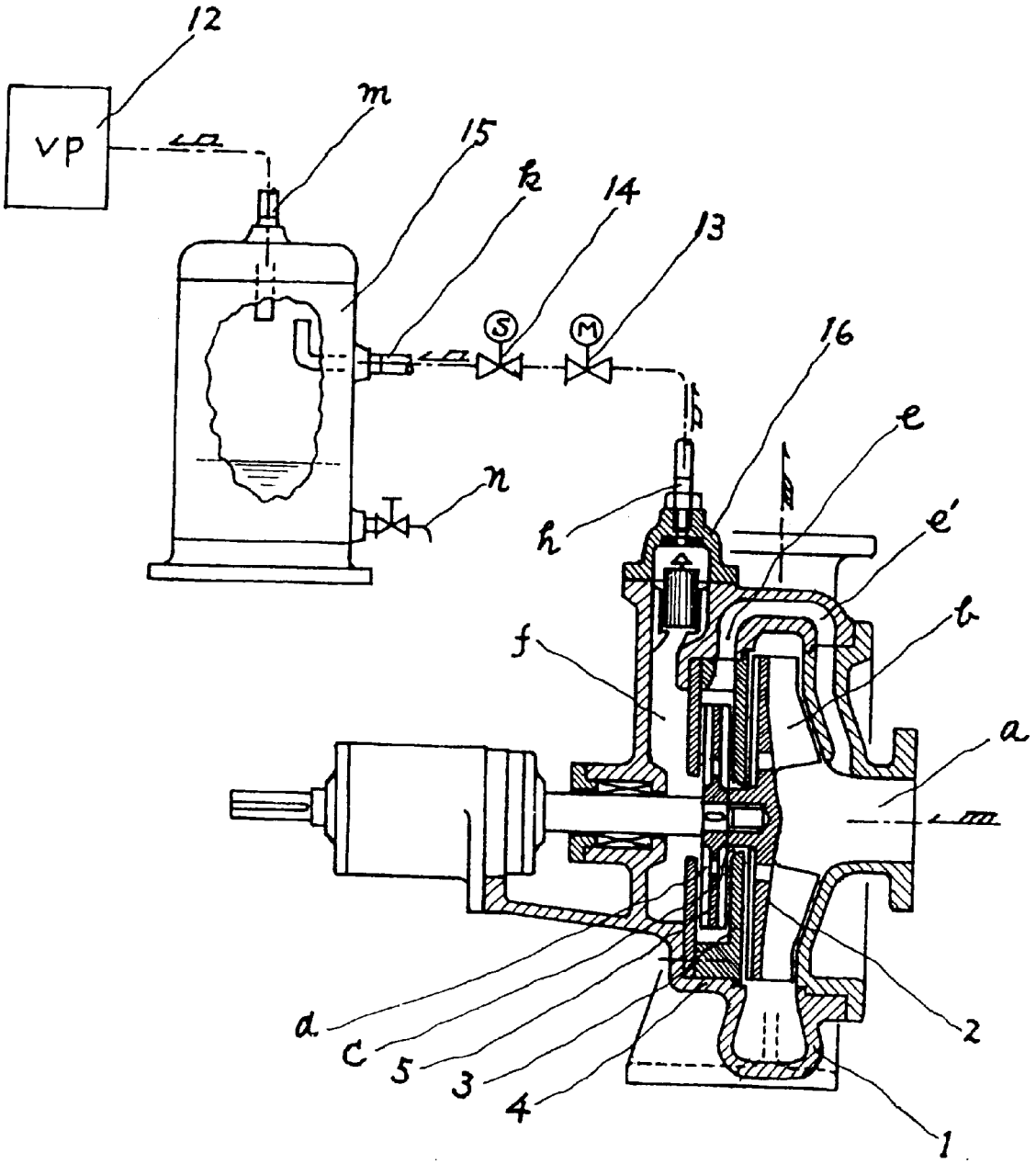
FIG. 1 is a longitudinal sectional view, partly in side elevation, of a first embodiment of the present invention.

In the following description like parts shown in the accompanying drawings are designated by the same reference characters. A self-priming centrifugal pump in a first embodiment of the present invention will be described with reference to FIG. 1.

Referring to FIG. 1, there are shown a main pump unit casing 1, a main impeller 2, a partition wall 3 separating a main pump unit and an auxiliary pump unit, an auxiliary pump unit casing 4, and an auxiliary impeller 5. In FIG. 1, both the main impeller 2 and the auxiliary impeller 5 are shown as a semi-open type for simplification. The front and the back side of a central part of each of the impellers 2 and 5 communicate with each other by means of holes or slits. A gap c is formed between a central opening formed in the partition wall 3 disposed between the pumps and a shaft extended through the central opening. The gap c serves as the suction opening of the auxiliary pump unit opening into a central region of the main pump unit. The passage area of the suction opening is very small as compared with the discharge ability of the auxiliary pump unit. A part of the gap on the side of the auxiliary pump unit may be expanded to prevent foreign matters and the like from stopping up the gap. A rubber member may be combined with the partition wall 3 of a hard material to enhance the durability of the partition wall 3, and teeth may be formed in the rim of the gap to crush fibrous matters and the like.

The discharge opening e of the auxiliary pump unit communicates with the suction side of the main pump unit by means of a return passage e'. Bubbles collected in a region in the vicinity of a central part of the auxiliary pump unit are guided to a vacuum device 12 through an exhaust passage f opening into a central part of the auxiliary pump unit opposite the side in which the suction opening c is formed.

The vacuum device 12 may be a liquid-seal type vacuum pump, a vacuum pump of other types or a vacuum creating device of any suitable type.

These three devices, i.e., the main pump unit, the auxiliary pump unit and the vacuum device, may be controlled in a sequence control mode so that the three devices are started and stopped at different times, respectively. However, in view of the purport of the present invention aiming at perfect automatic operation, it is desirable to operate those three devices simultaneously, and the following description will be given on an assumption that those devices are operated simultaneously.

Operations of the main pump unit and the auxiliary pump unit shown in FIG. 1 will be explained.

The pump is started. (Needless to say, a check valve is connected to the discharge opening of the main pump unit to make the main pump unit unable to suck a liquid or a gas through the discharge opening.) When the operating speed of the pump increases to a normal operating speed, a gas sucked through the suction side of the main pump unit is discharged through a passage a→b→c→d→f and a passage a→e'→e→d→f into the vacuum device 12, and the suction opening a and the pumping chamber b of the main pump unit are filled up with the liquid in a short time. On the other hand, the liquid fills up the return passage e' and tends to flow into the pumping chamber d of the auxiliary pump unit. However, since the discharge ability of the auxiliary impeller 5 of the auxiliary pump unit surpasses the suction (vacuum) of the vacuum device 12, the auxiliary pump unit functions as a check valve resisting the suction of the vacuum device 12, preventing the liquid to flow from the return passage e' into the auxiliary pump unit. Therefore, the liquid is sucked through the suction opening c of the auxiliary pump unit into the pumping chamber d of the auxiliary pump unit. Since, as mentioned above, the suction opening c has a small passage area as compared with the discharge ability of the auxiliary pump unit, all the liquid sucked into the auxiliary pump unit is discharged through the discharge opening e into the return passage e'.

Even if cavities are formed in a central part of the main pump unit by the gas contained in the pumped liquid, the gas forming the cavities is sucked immediately into the auxiliary pump unit and is discharged through the exhaust passage f into an exhaust passage h. Since the auxiliary impeller 5 of the auxiliary pump unit produces a pressure surpassing the suction (vacuum) of the vacuum device 12 and serves as the impeller of a centrifugal gas-liquid separating impeller, the gas and the liquid are separated immediately from each other, the liquid is returned to the main pump unit, the gas filling up the cavities formed in the region in the vicinity of the central part of the auxiliary impeller 5 is discharged and the liquid is sucked continuously and safely. Since the pumped liquid does not flow into the exhaust passage h while the pump is in operation, the vacuum device 12 is safe from the pumped liquid.

Thus, the pump of the present invention exercises its characteristic pumping ability and is capable of easily pumping substances which are difficult to pump by conventional centrifugal pumps, such as hot water, boiling solutions, slurry and the like, not to mention pumping simple liquids, such as water.

Mechanisms associated with the exhaust passages shown in FIG. 1 will be described hereinafter.

Basically, the exhaust passage connecting the auxiliary pump unit to the vacuum device 12 is provided, in a series arrangement, with a slow-acting valve 13 principally for opening the exhaust passage with a delay after the pump has been started and a quick-acting valve 14 principally for closing the exhaust passage immediately after the stoppage of the pump.

The slow-acting valve 13 is, for example, a moor-operated valve which opens with a delay after the pump has started. The delayed action of the slow-acting valve 13 is controlled electrically by a control system, not shown. The slow-acting valve 13 opens the exhaust passage with a delay after a prime mover for driving the pump has been connected to a power source, regardless of the condition of the quick-acting valve 14 and, consequently, the suction of the pumped liquid by the vacuum device at the moment the pump is started can be prevented.

The quick-acting valve 14 is, for example, a solenoid valve which closes instantly upon the stoppage of the pump. The operating principle and the construction of the solenoid valve are generally known and hence the description thereof will be omitted. The quick-acting valve 14 closes the exhaust passage forcibly upon the disconnection of the prime mover for driving the pump from the power source, regardless of the condition of the slow-acting valve 13 and, consequently, the quick-acting valve 14 prevents the suction by the vacuum device of the pumped liquid pumped by the main pump unit and the flow of the liquid from the vacuum device into the main pump unit at the moment the pump is stopped.

The slow-acting valve 13 and the quick-acting valve 14 may be united in an integral construction. For example, the slow-acting valve 13 and the quick-acting valve 14 may be replaced with a single valve capable of being controlled so as to open with a delay and to close instantly. In FIG. 1 the slow-acting valve 13 and the quick-acting valve 14 are disposed separately to facilitate the understanding of the concept of the slow-acting valve 13 and the quick-acting valve 14.

In the embodiment shown in FIG. 1, the exhaust passage is provided, in a series arrangement, with a float valve 16 and a liquid tank 15 serving as safety devices.

The float valve 16 shown as an example is of a common type having a float facing a central part of the auxiliary pump unit, and a valve element and a valve seat disposed opposite to the float. The float valve 16, which is closed by a buoyancy exerted on the float by the liquid, closes the exhaust passage forcibly to prevent the suction of the pumped liquid from the main pump unit into the side of the vacuum device at any time when the pump is started, while the pump is in operation or when the pump is stopped, when the liquid level in the auxiliary pump unit rises. Therefore, the flow of the pumped liquid into the vacuum device can be prevented even if the exhaust side of the auxiliary pump unit is filled up accidentally with the pumped liquid due to the clogging of the return passage e' for returning the liquid from the auxiliary pump unit into the main pump unit or due to the unsatisfactory operation of the damaged auxiliary impeller 5.

The liquid tank 15 shown as an example for storing the liquid is provided in its upper part with an inlet k connected to the auxiliary pump unit, and an outlet m connected to the vacuum device. The liquids which come from the auxiliary pump unit and the vacuum device are stored in the bottom part of the liquid tank 15 and only gases are able to flow through the liquid tank 15. Thus, in an emergency, such as a state where the series of the functional devices is damaged and unable to function properly, the liquid flowing through the exhaust passage is trapped by the liquid tank and the liquid is not allowed to flow from the auxiliary pump unit into the vacuum device, and from the vacuum device into the auxiliary pump unit for the perfect safety management of the apparatus. The liquid tank 15 is provided in its lower part with a drain port n to drain the liquid from the liquid tank 15. The liquid collected in the liquid tank may be drained through drain port n by a manual operation, by an automatic operation which opens the drain port n when the quantity of the liquid collected in the liquid tank increases to a predetermined quantity, or may be continuously drained by suction. Desirably, the liquid tank 15 is formed of a transparent material to enable the recognition of the quantity of the liquid collected in the liquid tank 15.

The four functional devices, i.e., the slow-acting valve 13, the quick-acting valve 14, the float valve 16 and the liquid tank 15, exercise characteristic effective operations, respectively.

Only one, two or three of these four functional devices are able to achieve necessary and sufficient functions if piping conditions at the site or the quality of the liquid permits. In FIG. 1, the pump is provided with all the four functional devices to perfectly meet conditions for handling chemicals or foodstuffs.

A self-priming centrifugal pump in a second embodiment of the present invention will be described with reference to FIG. 2. The second embodiment employs a liquid-seal type vacuum pump 12 as a vacuum device, and a hydraulic slow-acting valve 13. A liquid tank 15 has a pipe having a lower end part extending into the suction port i of the vacuum pump 12 and an upper end part opening into an upper part of the liquid tank 15, and is joined directly to the vacuum pump 12.

The operating principle and the construction of the liquid-seal type vacuum pump 12 are the same as those of a generally known Nash pump and hence the description thereof will be omitted. The working fluid of the vacuum pump 12 is a liquid meeting the requirements of the site, such as an oil or water. If the liquid pumped by the pump is clean, the liquid may be used as the working fluid of the vacuum pump 12

Figure 2:
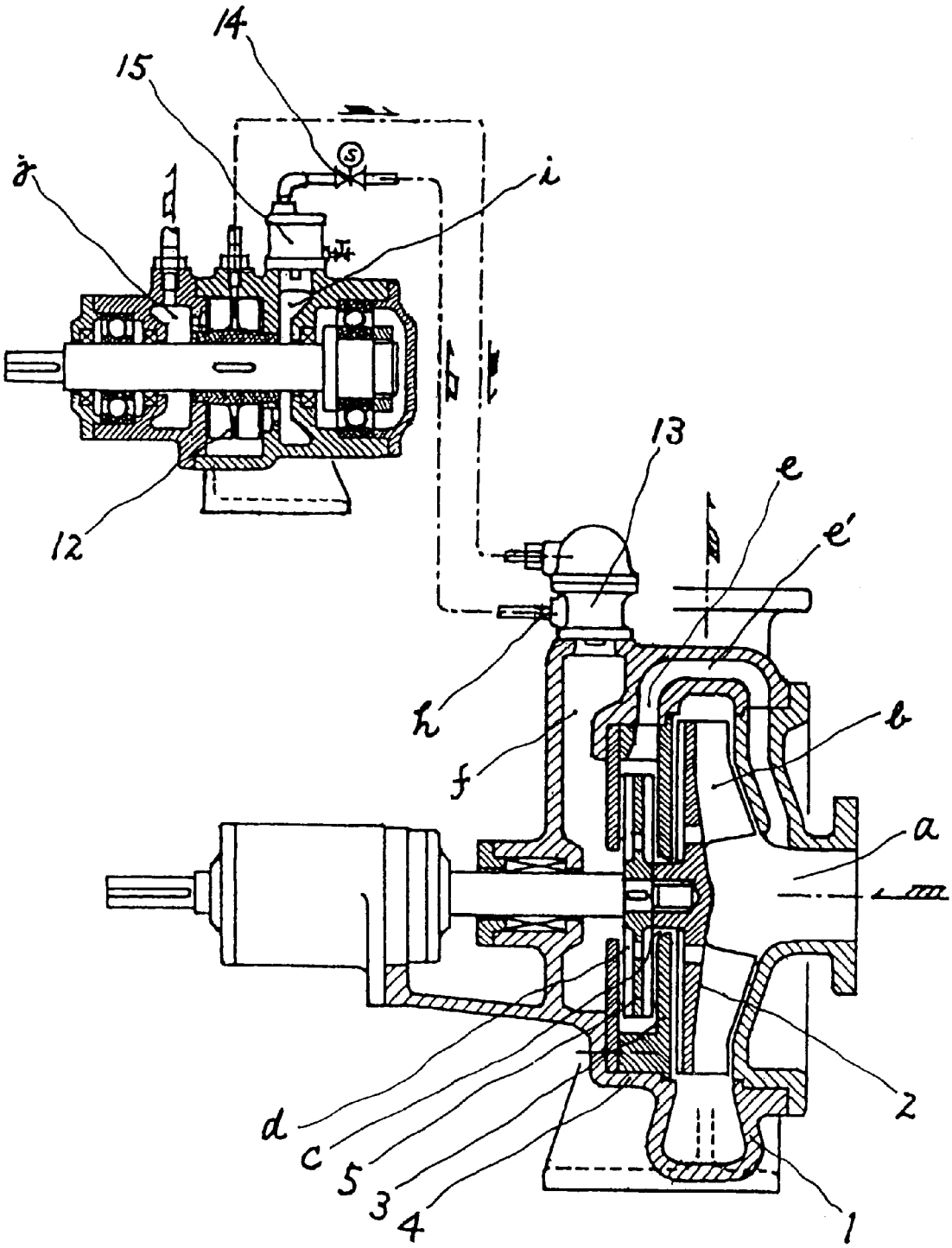
FIG. 2 is a longitudinal sectional view, partly in side elevation, of a second embodiment of the present invention.
Figure 3:
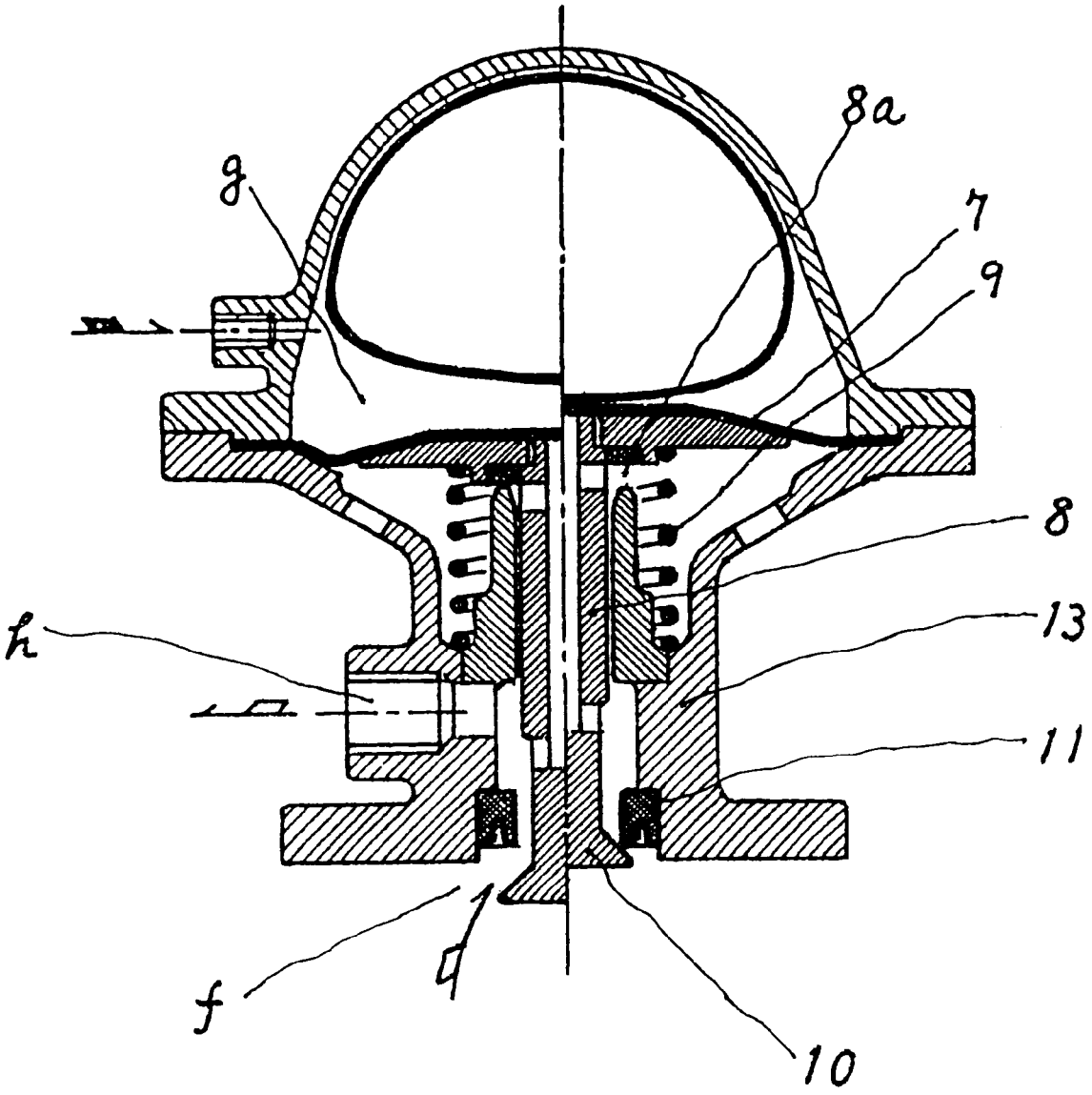
FIG. 3 is a longitudinal sectional view of a slow-acting valve employed in the present invention.

FIG. 3 shows, by way of example, the construction of the slow-acting valve 13 shown in FIG. 2. A valve seat 11 is fitted in an opening formed in the bottom part of a valve casing, and a sealing member 7, such as a diaphragm, is fixed to an upper part of the valve casing. A valve driving chamber g is formed between the sealing member 7 and a valve cover. A connecting rod 8 has one end attached to the sealing member 7 and the other end connected to a valve element 10 to be seated on the valve seat 11. The connecting rod 8 is biased in a direction to seat the valve element 10 on the valve seat 11 by a biasing member 9. The valve casing is provided with an exhaust passage h connected to the suction port of the vacuum pump 12. Needless to say, the diaphragm serving as the sealing member may be substituted by a bellows, a piston or the like.

When the pressure in the valve driving chamber g is gradually raised by the pressure of the working fluid supplied from the vacuum pump 12 into the valve driving chamber g, and reaches a level to overcome the force of the biasing member 9, the sealing member 7 is moved to separate the valve element 10 from the valve seat 11, so that the exhaust passage is opened.

The slow-acting valve 13 shown in FIG. 3 is provided with a ventilating mechanism 8*a* interlocked with the valve element 10 so as to connect the exhaust side of the slow-acting valve 13 to the atmosphere when the valve element 10 is at its valve closing position. In an initial period of operation of the pump subsequent to the start of the pump, the vacuum pump 12 sucks the atmosphere and its evacuating effect is reduced to increase a delay time by which the creation of a vacuum is delayed in order that the possibility of the suction of the pumped liquid pumped by a main pump unit by the vacuum pump 12 can further be decreased. In the slow-acting valve shown in FIG. 3, the ventilating mechanism 8*a* comprises the connecting rod 8 provided with a hole, and a valve disposed near the joint of the connecting rod 8 and the sealing member 7. Needless to say, the ventilation mechanism 8*a* need not be of an interlocked twin valve type as shown in FIG. 3 and may be of any suitable type.

The slow-acting valve 13 shown in FIG. 3 is provided with a bag sealing a gas therein and placed in the valve driving chamber g. The gas sealed in the bag is compressed by the pressure of the liquid supplied into the valve driving chamber g after the vacuum pump 12 has been started to delay the increase of the pressure in the valve driving chamber g so that the valve element 10 may not directly be driven by the pressure of the working fluid to further delay the operation of the valve element 10. Practically, the function of the bag and the gas sealed in the bag may be exercised by a gas contained in the valve driving chamber g. Naturally, the operation of the valve element 10 can be delayed by reducing the passage area of a passage through which the working fluid is supplied into the valve driving chamber g.

Figure 4:
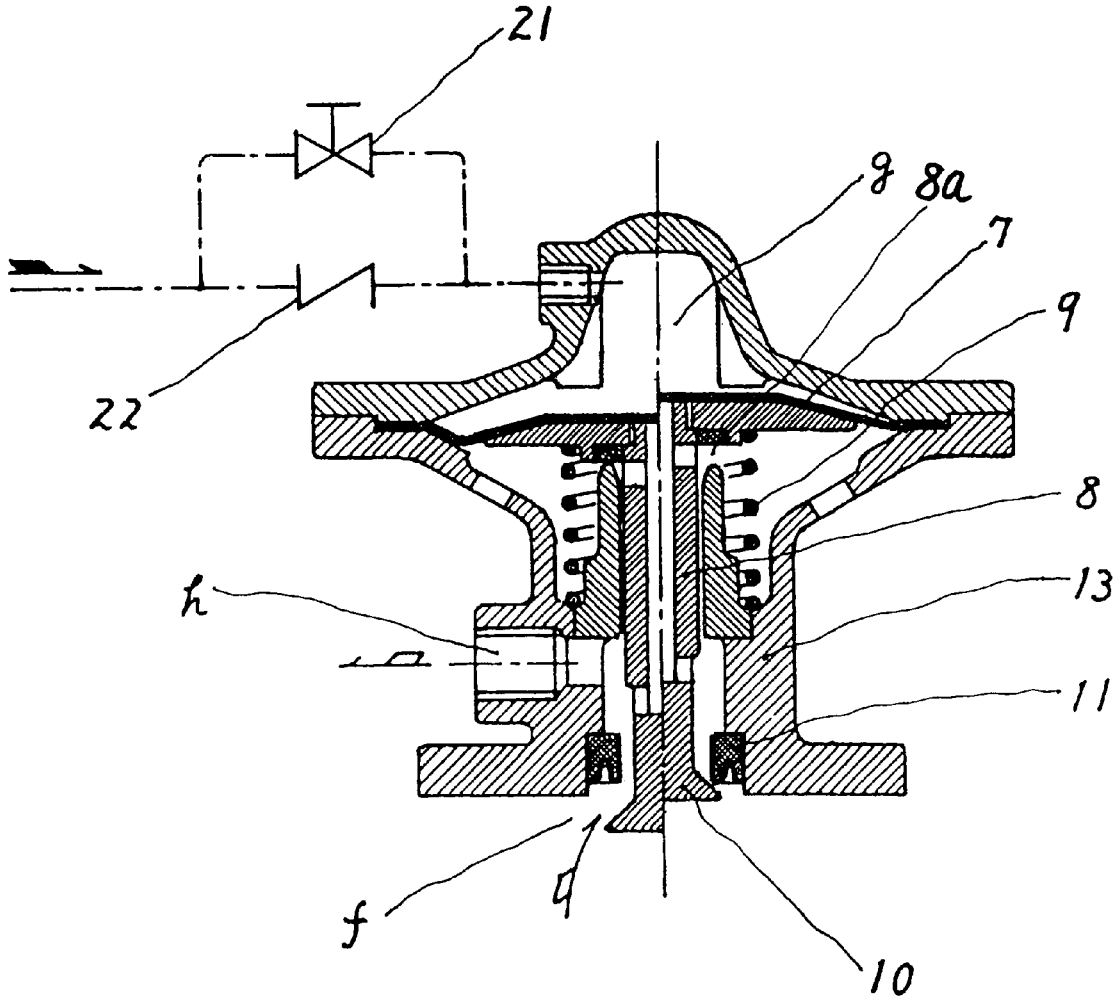
FIG. 4 is a longitudinal sectional view of a slow-acting and quick-acting valve employed in the present invention.

A single valve as shown by way of example in FIG. 4 is capable of opening with a delay and of closing instantly and can be constructed by integrally incorporating a quick-acting valve into the slow-acting valve 13. As shown in FIG. 4, a restrictor 21 is placed in a passage through which the working fluid is supplied from the liquid-seal type vacuum pump 12 into the valve driving chamber g. A check valve 22 limiting flow to a direction from the valve driving chamber g toward the vacuum pump 12 is connected to the passage in parallel to the restrictor 21. The working fluid flows through the passage in opposite directions at different flow rates, respectively, to open the valve 13 with a delay and to close the valve 13 instantly. Time necessary for the valve 13 to open and time necessary for the valve 13 to close can be adjusted by selectively determining the opening of the restrictor 21 and the bore diameter of the check valve 22. The construction of the valve 13 is the same in other respects as that of the slow-acting valve 13 shown in FIG. 3 and the further description of the valve 13 will be omitted.

Figure 5:
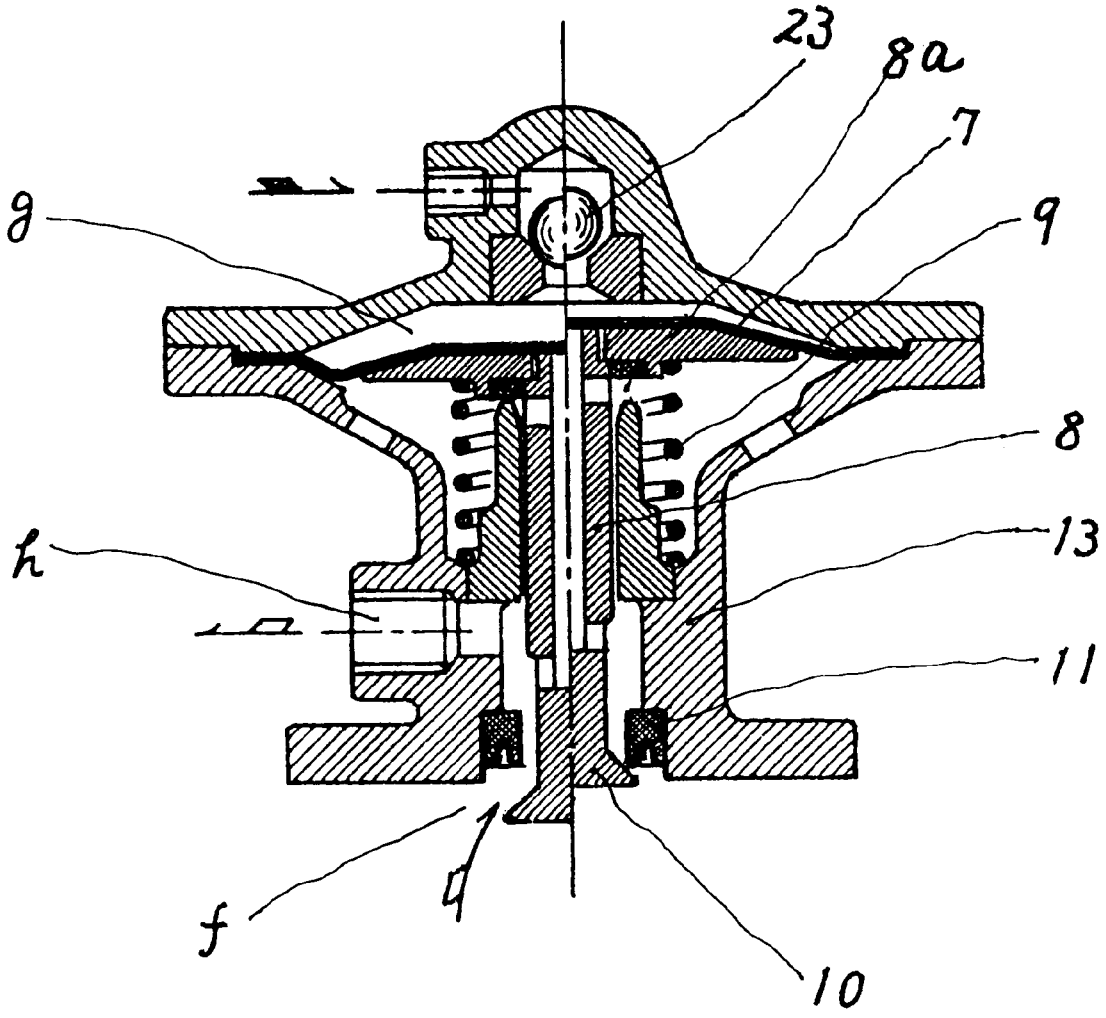
FIG. 5 is a longitudinal sectional view of a slow-acting and quick-acting valve employed in the present invention.

FIG. 5 shows, by way of example, a valve of a construction similar to but simpler than that of the valve shown in FIG. 4. The valve shown in FIG. 5 is provided with a valve element 23 placed in a passage through which a working fluid is supplied into a valve driving chamber g and the functions of the restrictor 21 and the check valve 22 are substituted by the valve element 23. The valve element 23 has an irregular surface or is provided with a hole to leave a narrow passage when the same is seated on a valve seat. The passage area is reduced when the valve element 23 is seated on the valve seat and the passage area is increased when the same is separated from the valve seat. The construction of the valve shown in FIG. 5 is the same in other respects as that of the valve shown in FIG. 4 and hence further description thereof will be omitted.

It stands to reason that the quick-acting valve 14 can be omitted when the slow-acting valve 13 having the function of a quick-acting valve as shown in FIG. 4 or 5 is employed. However, the quick-acting valve 14 may be left unomitted to use the same as a safety device for surely preventing the flow of liquid from the side of the main pump unit to the side of the vacuum device, and from the latter to the former.

Figure 6:
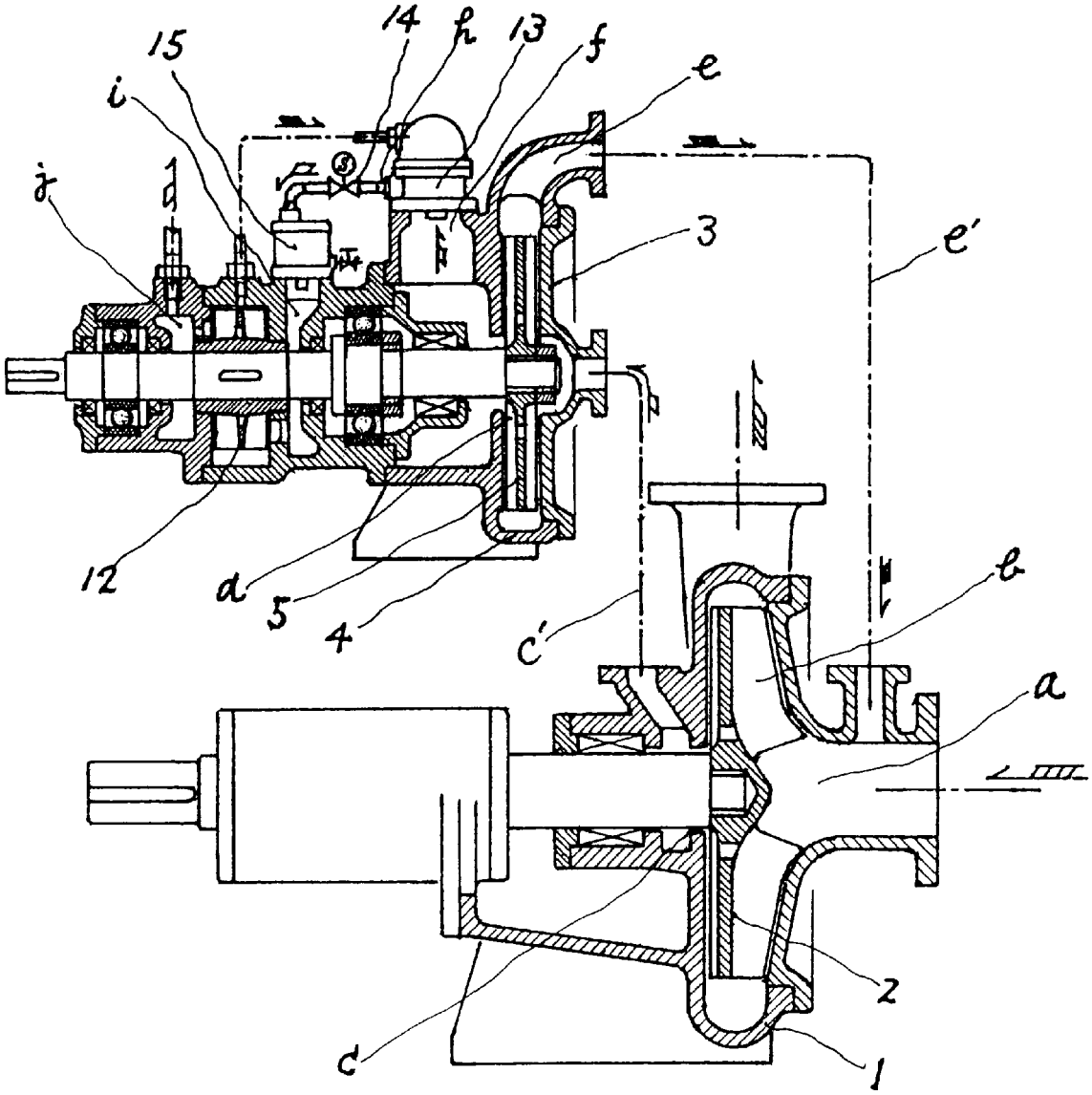
FIG. 6 is a longitudinal sectional view, partly in side elevation, of a third embodiment of the present invention.

FIG. 6 shows a self-priming centrifugal pump in a third embodiment of the present invention. This pump has an auxiliary pump unit corresponding to that of the pump shown in FIG. 2 and disposed coaxially with a vacuum device. The construction and functions of the pump in the third embodiment are the same in other respects as those of the pump shown in FIG. 2 and hence further description of the pump shown in FIG. 6 will be omitted.

Figure 7:
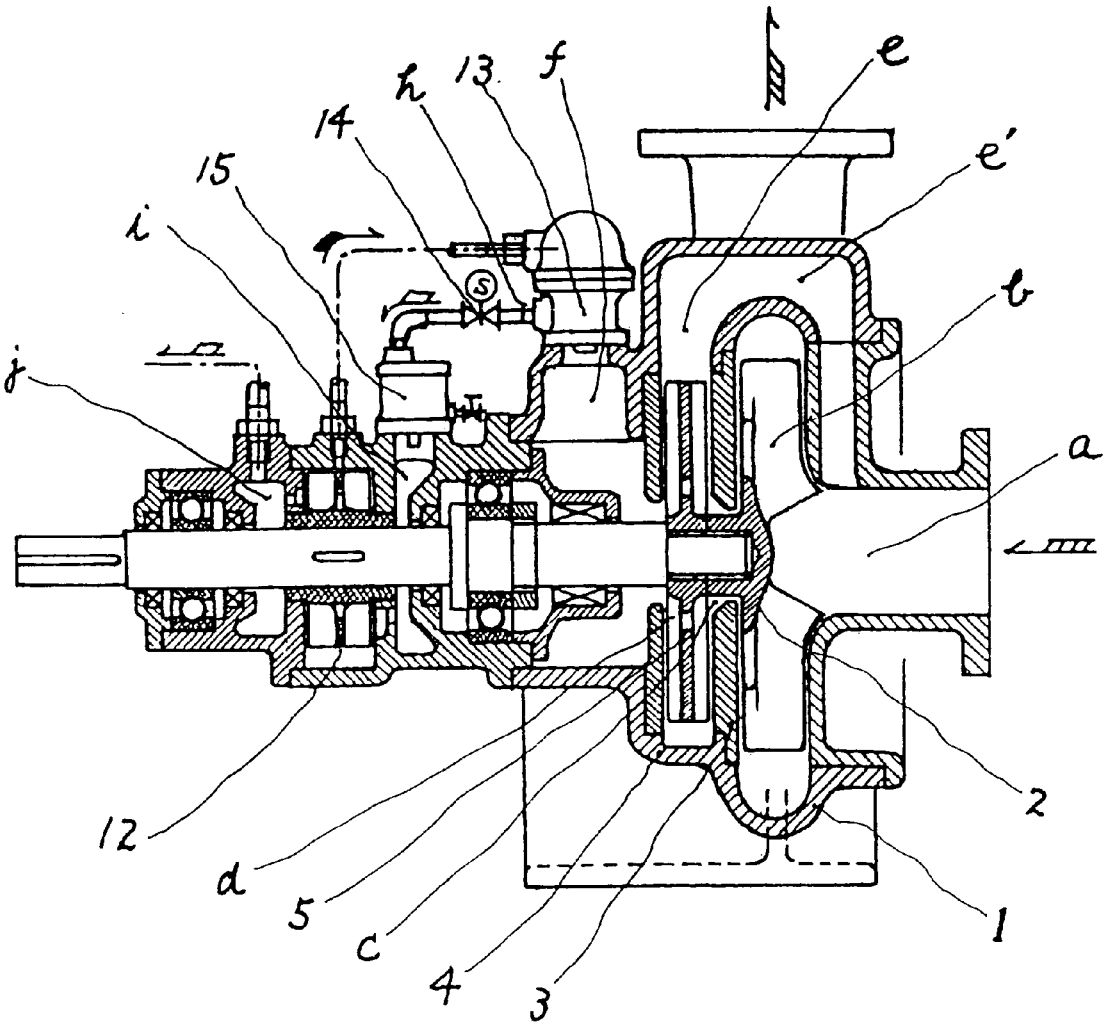
FIG. 7 is a longitudinal sectional view, partly in side elevation, of a fourth embodiment of the present invention.

FIG. 7 shows a self-priming centrifugal pump in a fourth embodiment of the present invention. This pump has a main pump unit, an auxiliary pump unit and a vacuum device respectively corresponding to those of the pump shown in FIG. 2 and disposed coaxially with each other. The main pump unit shown is provided with an open type impeller. The construction and functions of the pump in the fourth embodiment are the same in other respects as those of the pump shown in FIG. 2 and hence further description of the pump shown in FIG. 7 will be omitted.

Figure 8:
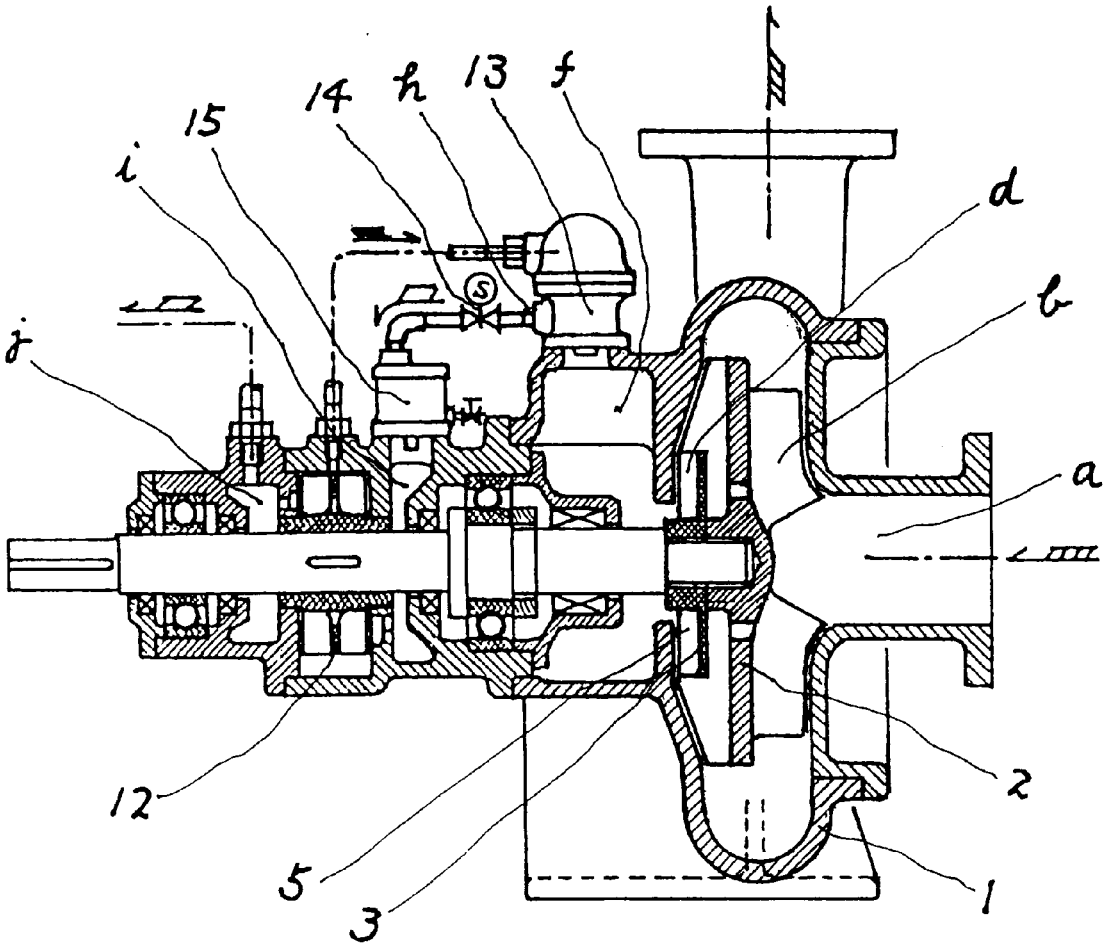
FIG. 8 is a longitudinal sectional view, partly in side elevation, of a fifth embodiment of the present invention.

FIG. 8 shows a self-priming centrifugal pump in a fifth embodiment of the present invention. In this pump, the impeller 2 of the main pump unit and the impeller 5 of the auxiliary pump unit shown in FIG. 7 are united together in a contiguous arrangement. This pump has a compact construction. The construction and functions of the pump in the fifth embodiment are the same in other respects as those of the pump shown in FIG. 7 and hence further description of the pump shown in FIG. 8 will be omitted.

Figure 9:
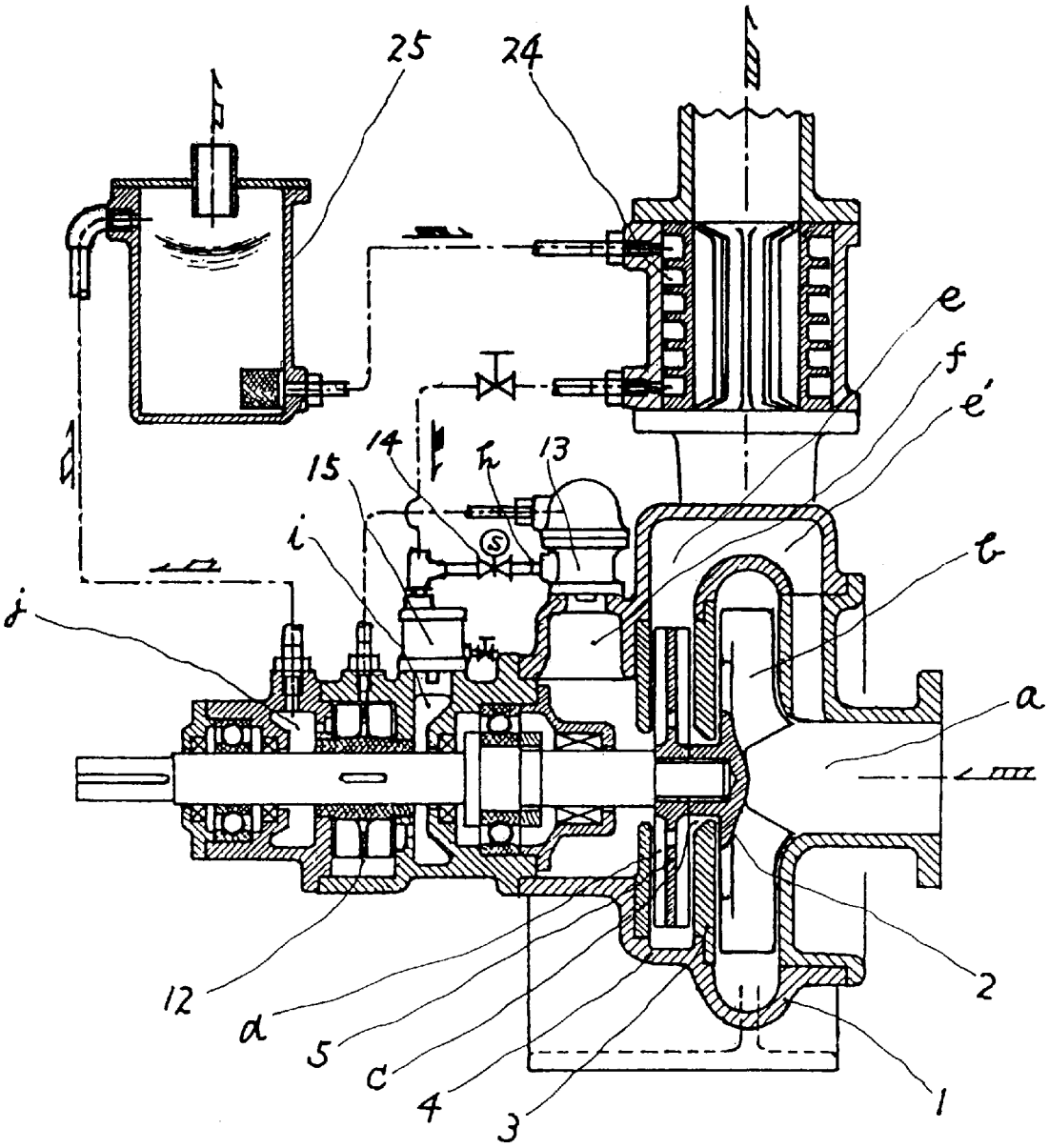
FIG. 9 is a longitudinal sectional view, partly in side elevation, of a sixth embodiment of the present invention.

FIG. 9 shows a self-priming centrifugal pump in a sixth embodiment of the present invention. In this pump, a cooling device 24 for cooling the working fluid of a liquid-seal type vacuum pump 12 is combined with the delivery line of the main pump unit shown in FIG. 7. The cooling device 24 has an inlet port connected to the exhaust port j of the vacuum pump 12 and an outlet port connected to the suction port i of the vacuum pump 12. The working fluid of the vacuum pump 12 is cooled to prevent drop in function of the vacuum pump due to rise in the temperature of the working fluid that occurs when the vacuum pump 12 is operated for a long time, whereby the performance and the durability of the pump can be improved. In FIG. 9, indicated at 25 is a liquid separator which separates the working fluid from the gas discharged through the exhaust port j of the vacuum pump 12 and sends working fluid to the cooling device 24. Desirably, the gas is flown into the liquid separator 25 in a direction tangent to the wall surface of the liquid separator 25 to use the liquid separating effect of centrifugal force. The construction and functions of the pump in the sixth embodiment are the same in other respects as those of the pump shown in FIG. 7 and hence further description of the pump shown in FIG. 9 will be omitted.

Figure 10:
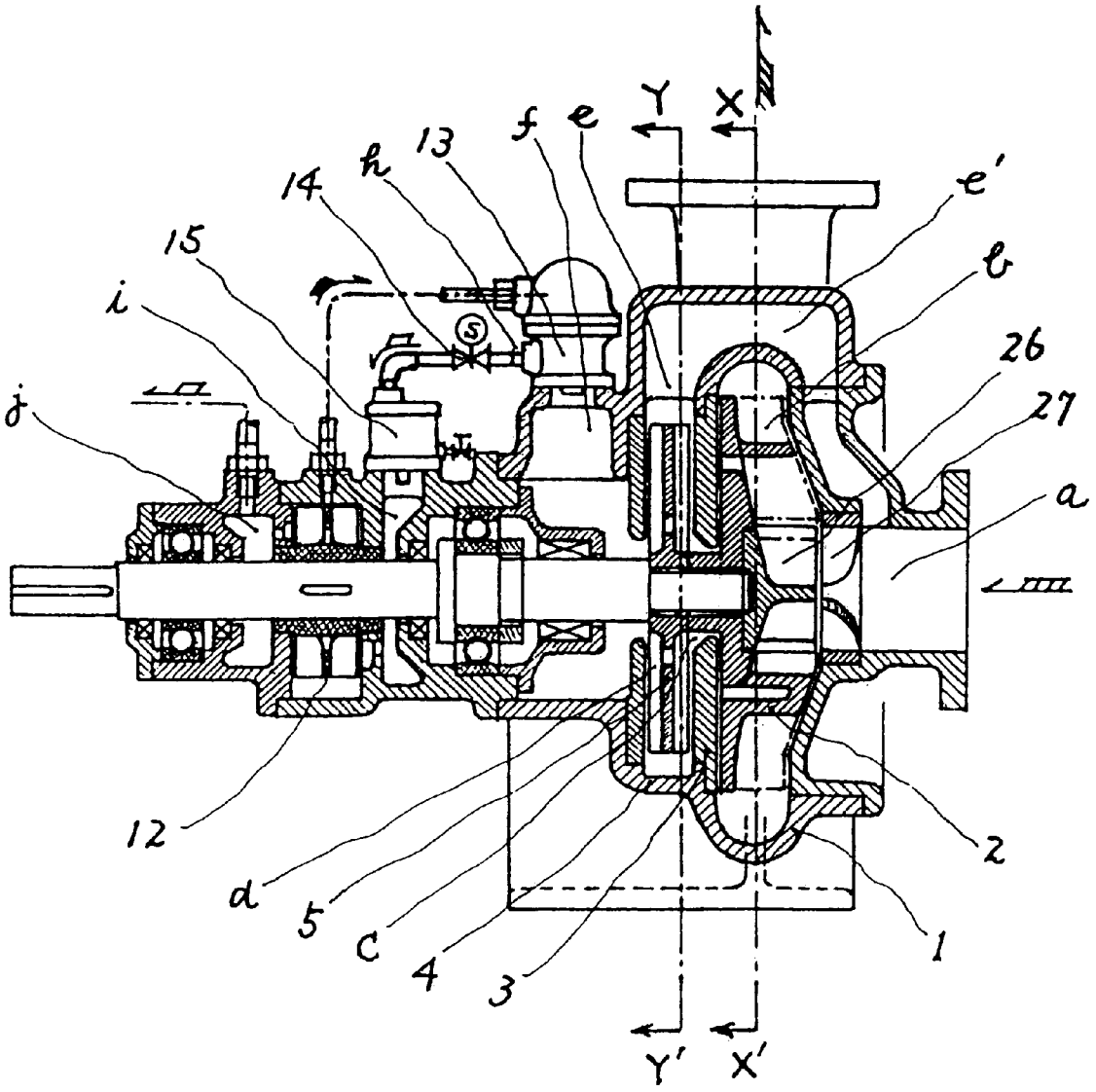
FIG. 10 is a longitudinal sectional view, partly in side elevation, of a seventh embodiment of the present invention.
Figure 11:
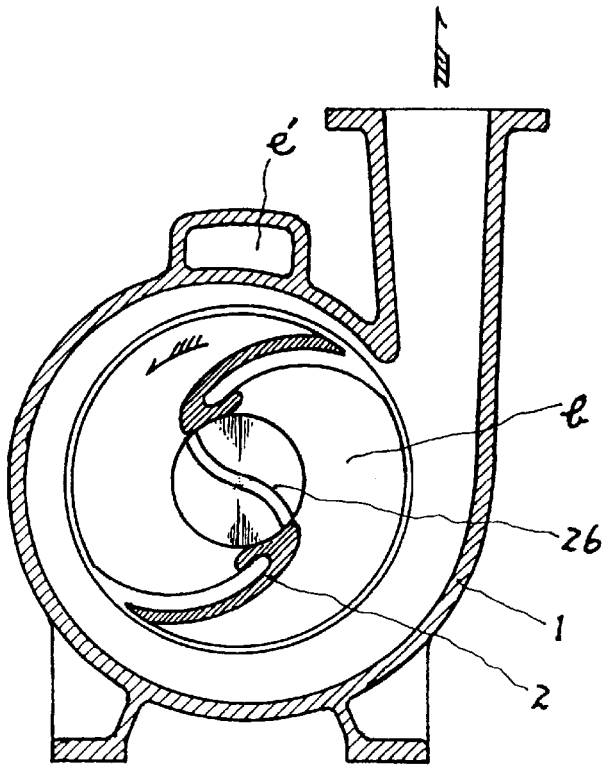
FIG. 11 is a sectional view, partly in front elevation, taken on line X–X' in FIG. 10.
Figure 12:
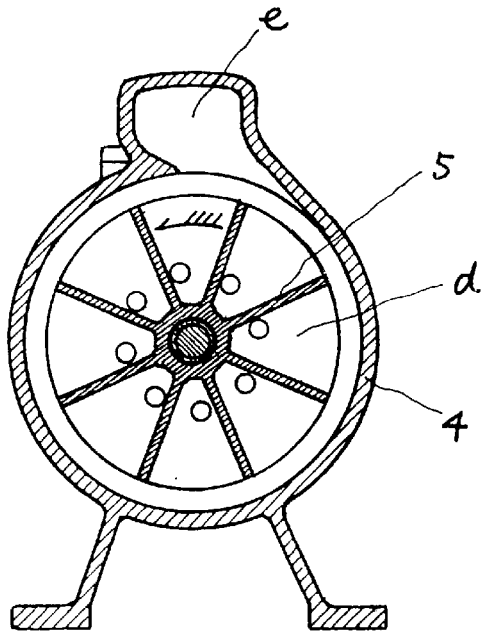
FIG. 12 is a sectional view taken on line Y—Y' in FIG. 10.

FIG. 10 shows a self-priming centrifugal pump in a seventh embodiment of the present invention. In this pump, a rotary cutting blade 26 is disposed coaxially with the main impeller 2 of the main pump unit shown in FIG. 7 on the suction side of the main impeller 2, and a fixed cutting blade 27 is disposed on the casing 1 shown in FIG. 7 so as to correspond to the rotary cutting blade 26 to construct a crushing device. The crushing device crushes foreign matters which often block up the main pump unit while the pump is in operation, whereby the performance and the durability of the pump can be improved. More specifically, when pumping sewage, the crushing device crushes efficiently fibers, lumps, impurities and the like contained in the sewage. FIGS. 11 and 12 are sectional views taken on line X'X' and line Y–Y' in FIG. 10, respectively, and showing the respective shapes of the main impeller 2 and the auxiliary impeller 5, slits between the front and the back surface of the main impeller 2, and through holes between the front and the back surface of the auxiliary impeller 5. The construction and functions of the pump in the seventh embodiment are the same in other respects as those of the pump shown in FIG. 7 and hence further description of the pump shown in FIG. 10 will be omitted.

Figure 13:
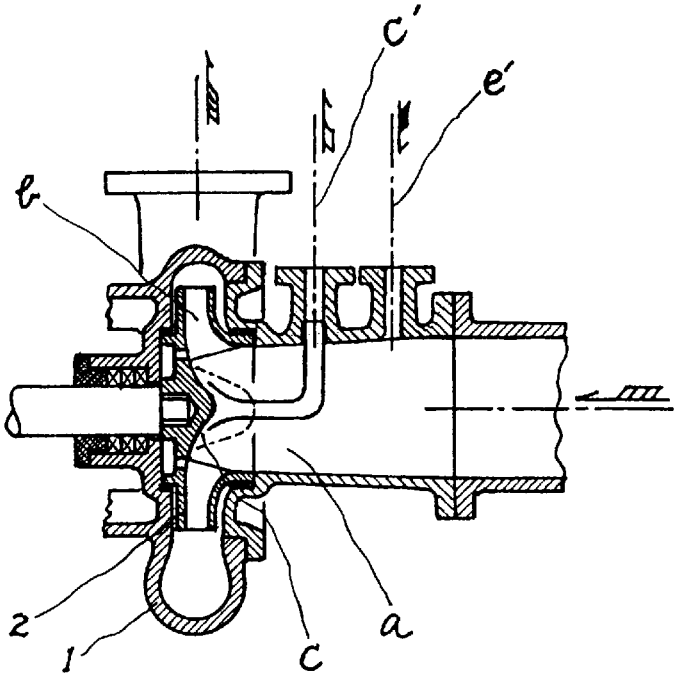
FIG. 13 is a longitudinal sectional view of an eighth embodiment of the present invention.

FIG. 13 shows a self-priming centrifugal pump in an eighth embodiment of the present invention. In this pump, there is provided a suction opening c of a connecting passage c' for connecting a region in the vicinity of a central part of the impeller of a main pump unit and the suction opening of an auxiliary pump unit included in the pump shown in FIG. 6. The suction opening c is formed on the suction side of the main impeller 2 so as to open into a cavity forming region of a shape indicated by alternate long and short dash line in FIG. 13. The discharge opening of the auxiliary pump unit is connected to the suction opening a of the main pump unit by a return passage e'. The construction and functions of the pump in the eighth embodiment are the same in other respects as those of the pump shown in FIG. 6 and hence further description of the pump shown in FIG. 13 will be omitted.

Figure 14:
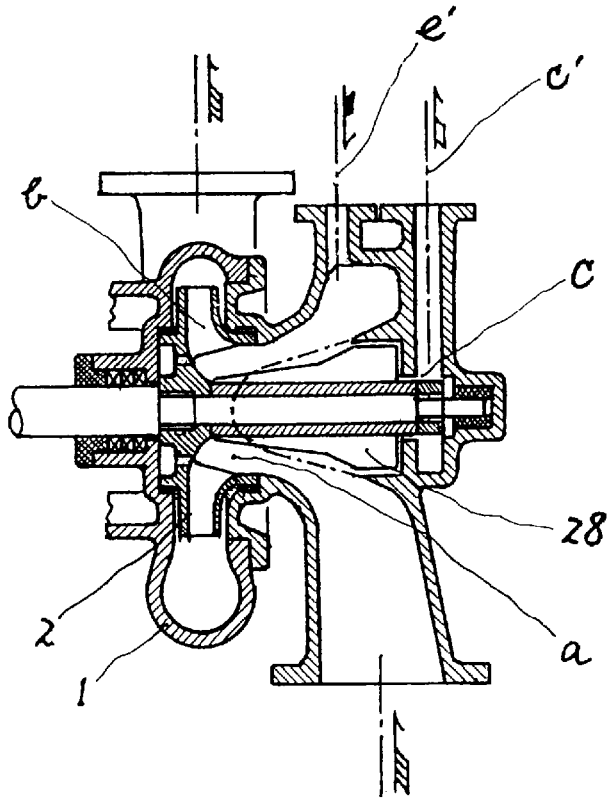
FIG. 14 is a longitudinal sectional view of a ninth embodiment of the present invention.
Figure 15:
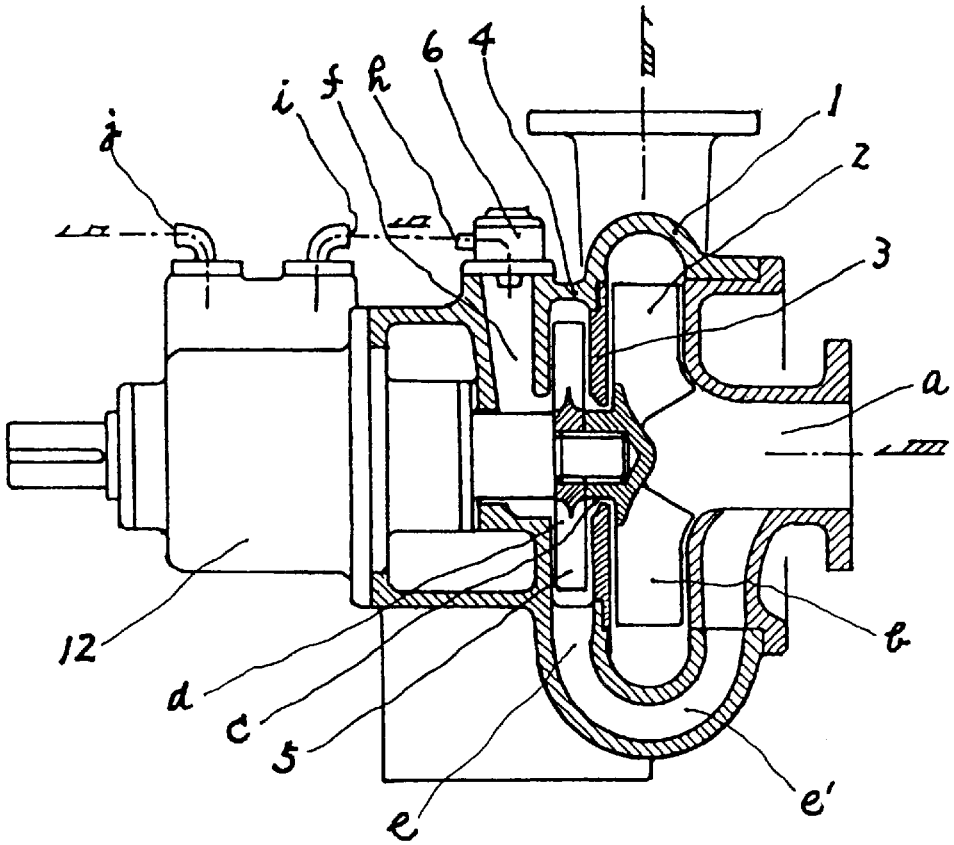
FIG. 15 is a longitudinal sectional view, partly in side elevation, of a prior art self-priming centrifugal pump.
Figure 16:
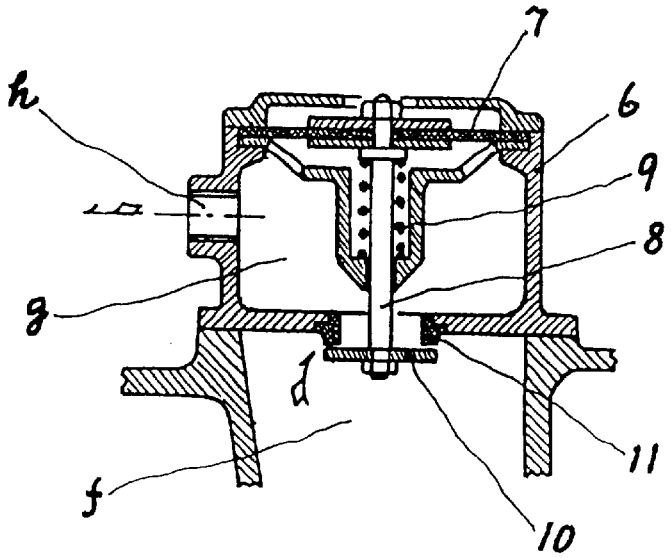
FIG. 16 is a longitudinal sectional view of a safety valve employed in the self-priming centrifugal pump of FIG. 15.

FIG. 14 shows a self-priming centrifugal pump in a ninth embodiment of the present invention. This pump is a development of the pump shown in FIG. 13. In this pump, blades 28 are disposed on the suction side of the impeller 2 of the main pump unit of the pump shown in FIG. 13 so as to rotate together with the impeller 2 of the main pump unit to discharge the gas forming cavities that are produced around the axis of rotation in a shape indicated by alternate long and short dash line into the auxiliary pump unit. The discharge opening of the auxiliary pump unit is connected to the suction opening a of the main pump unit by a return passage e'. The construction and functions of the pump in the ninth embodiment are the same in other respects as those of the pump shown in FIG. 13 and hence further description of the pump shown in FIG. 14 will be omitted.

The following modifications may be made in all the foregoing embodiments.

The main impeller 2 may be of any known type, such as a nonclog type, an open type, a semi-open type or a closed type.

The type of the auxiliary pump unit may be of any known type, and the shape of the auxiliary impeller 5 may be any known shape. The pump may be provided with a plurality of auxiliary pump units for a further effective gas-liquid separation. The return passage e' connecting the discharge opening of the auxiliary pump unit to the suction side of the main pump unit may be formed in the main pump casing 1 when casting the main pump casing 1 or may be a pipe having one end connected to the auxiliary pump unit and the other end connected to the main pump unit.

The vacuum device 12 may be any one of known vacuum devices. The pump may be provided with only the vacuum device 12 or may be provided with an additional vacuum device connected to a branch line branched from a line connected to the vacuum device 12.

The main pump unit, the auxiliary pump unit and the vacuum device may be coaxially arranged on the same shaft or may have different shaft systems, respectively. The main pump unit, the auxiliary pump unit and the vacuum device may have different shafts, respectively.

The foregoing embodiments may be individually used or may be used in combination.

The number, the positional relation and order of arrangement of the components may be changed, conventional techniques may be employed and various changes may be made in design without departing from the scope of the invention. The materials of the components may be selectively determined so as to meet site requirements. The present invention is not limited in its practical application to the specific embodiments specifically described herein.

INDUSTRIAL APPLICABILITY

The present invention improves remarkably the durability and convenience of a self-priming centrifugal pump capable of sucking up and pumping a highly viscous liquid containing muddy substances containing a large amount of bubbles, and solid foreign matters by incorporating a new valve mechanism and the like capable of stable, reliable operation into the self-priming centrifugal pump without reducing the high performance of the self-priming centrifugal pump to prevent the flow of the liquid from the side of the main pump unit into the vacuum device and from the vacuum device into the main pump unit at all stages of operation including starting, operating and stopping stages. The self-priming centrifugal pump is capable of perfectly automatic operation and the devices are maintenance-free. Therefore, work load for the operation and maintenance is reduced greatly. The self-priming centrifugal pump can be easily formed in a large size or a small size. The self-priming centrifugal pump has a simple construction and is very economical in costs of equipment and maintenance.

What is claimed is:

1. A self-priming centrifugal pump comprising:

a main pump unit for pumping a liquid;

an auxiliary pump unit for centrifugal gas-liquid separation; and an exhaust vacuum device;

wherein a region in the vicinity of a central part of an impeller included in the main pump unit is connected via a passage having a small passage area as compared with a discharge ability of the auxiliary pump unit to a suction opening of the auxiliary pump unit, a delivery opening of the auxiliary pump unit is connected via a return passage to the suction opening of the main pump unit, a region in the vicinity of a central part of an impeller included in the auxiliary pump unit is connected via an exhaust passage to the vacuum device, and said exhaust passage includes in series therein a slow-acting valve which opens with a delay after connection of a prime mover for driving the self-priming centrifugal pump to a power source, and a quick-acting valve which closes immediately after disconnection of the prime mover from the power source.

2. The self-priming centrifugal pump according to claim 1, wherein the slow-acting valve is a valve which is controlled electrically for a timed opening operation.

3. The self-priming centrifugal pump according to claim 1, wherein the quick-acting valve is a valve which is controlled electrically for a timed closing operation.

4. The self-priming centrifugal pump according to claim 1, wherein the vacuum device is provided with a liquid-seal type vacuum pump, and the slow-acting valve is a valve which opens when the pressure of a working fluid of the liquid-seal type vacuum pump increases.

5. The self-priming centrifugal pump according to claim 1, wherein the slow-acting valve and the quick-acting valve are united in a single valve capable of slow opening and of quick closing.

6. The self-priming centrifugal pump according to claim 1, wherein the exhaust passage is provided with valve means for connecting the exhaust passage to the atmosphere to reduce the vacuum force of the vacuum device when either the slow-acting valve or the quick-acting valve is closed to disconnect the exhaust passage from the region in the vicinity of the central part of the impeller of the auxiliary pump unit.

7. The self-priming centrifugal pump according to claim 1, wherein a float valve which opens when a liquid level in the exhaust passage of the auxiliary pump unit drops is connected in series to the exhaust passage.

8. The self-priming centrifugal pump according to claim 1, further comprising a liquid tank provided in an upper part with an inlet and an outlet and connected in series to the exhaust passage.

9. The self-priming centrifugal pump according to claim 1, wherein any or all of the main pump unit, the auxiliary pump unit and the vacuum device have different rotating shaft systems.

10. The self-priming centrifugal pump according to claim 1, wherein all of the main pump unit, the auxiliary pump unit and the vacuum device have one and the same rotating shaft system.

11. The self-priming centrifugal pump according to claim 1, wherein respective impellers of the main pump unit and the auxiliary pump unit are disposed contiguously and united together in a single unit.

12. The self-priming centrifugal pump according to claim 1, wherein the vacuum device is provided with a liquid-seal type vacuum pump, a cooling device for cooling the working fluid of the liquid-seal type vacuum pump is formed contiguously with a passage through which liquid pumped by the main pump unit flows, and the cooling device is provided with an inlet connected to an exhaust opening of the liquid-seal type vacuum pump, and an outlet connected to a suction opening of the liquid-seal type vacuum pump.

13. The self-priming centrifugal pump according to claim 1, further comprising a rotary cutting blade and a fixed cutting blade which are disposed adjacent to the suction opening of the main pump unit so as to correspond to each other.

14. The self-priming centrifugal pump according to claim 1, wherein the suction opening of the passage extending between the region in the vicinity of the central part of the impeller of the main pump unit and the suction opening of the auxiliary pump unit face a region adjacent to the suction side of the impeller of the main pump unit in which cavities are formed.

* * * * *

UNITED STATES PATENT AND TRADEMARK OFFICE

CERTIFICATE OF CORRECTION

PATENT NO. : 6,152,689
DATED : November 28, 2000
INVENTOR(S) : Hiroshi Yokota et al.

It is certified that error appears in the above-identified patent and that said Letters Patent is hereby corrected as shown below:

Title page, Item [54] and Column 1, line 1,
Title should read:
-- SELF-PRIMING TYPE CENTRIFUGAL PUMP --

Column 8,
Line 26, insert -- (registered trademark) -- after "Nash"

Signed and Sealed this

Fourth Day of February, 2003

JAMES E. ROGAN
*Director of the United States Patent and Trademark Office*